United States Patent [19]

Eide et al.

[11] 4,051,644

[45] Oct. 4, 1977

[54] APPARATUS FOR PRODUCING MATTRESSES

[75] Inventors: Richard H. Eide, Minneapolis; Gerald A. Golembeck, Lake Elmo, both of Minn.

[73] Assignee: The United States Bedding Company, St. Paul, Minn.

[21] Appl. No.: 729,386

[22] Filed: Oct. 4, 1976

[51] Int. Cl.[2] ..... B65B 63/02

[52] U.S. Cl. ..... 53/125; 53/257; 53/258; 100/242; 100/245; 156/423; 156/578

[58] Field of Search ..... 53/125, 257, 258, 260, 53/383; 100/242, 245; 156/423, 578

[56] References Cited

U.S. PATENT DOCUMENTS

| | | | |
|---|---|---|---|
| 2,590,327 | 3/1952 | Kay | 53/257 |
| 2,907,156 | 10/1959 | Anderson | 53/258 X |

*Primary Examiner*—Travis S. McGehee

*Attorney, Agent, or Firm*—McDougall, Hersh & Scott

[57] ABSTRACT

Mattress constructions and apparatus for producing the constructions wherein a resilient filler is located in a hopper and a flexible mattress cover is positioned for communication with the open end of the hopper. Means are provided for driving the filler into the cover, and the apparatus provides adhesive dispensers which apply adhesive to the filler surfaces so that this adhesive forms a bond between these surfaces and the associated cover. The apparatus employs engaging members for driving the filler out of the hopper, the engaging members automatically accommodate to differences in filler widths and thicknesses so that proper pushing engagement with the filler is reliably achieved. The resulting mattress is provided with a secure adhesive bond between the cover and filler, avoiding movement between the cover and filler during handling and use.

21 Claims, 13 Drawing Figures

APPARATUS FOR PRODUCING MATTRESSES

This invention relates to an apparatus for producing mattresses, and to the mattress constructions produced on the apparatus.

When used in this specification and the following claims, the term "mattress" is intended to include mattresses of the type normally used for beds as well as similar constructions including large cushions, mats, etc. As will become more apparent, the invention is applicable to mattresses of conventional design such as those employing foam interiors or inner spring construction.

In the production of mattresses of the type described, it is necessary to provide a means for locating a flexible cover material around the exterior of the inner spring or foam filler. In order to provide the most efficient production of such mattresses, attempts have been made to develop machinery for automatically inserting a filler within a mattress cover. In addition to increasing production speed, such machinery is intended to improve the reliability of the operation by providing greater consistency throughout the manufacturing operation.

Systems have been developed wherein a filler material such as a block of foam is located in a hopper defining an open end. A mattress cover is then located around the open end, and the filler is then pushed into the cover. This provides a convenient means for assembling the cover and a filler; however, during subsequent use, the cover would often "roll" or "gather" due to movement of the cover relative to the filler.

It is a general object of this invention to provide an improved apparatus for the production of mattresses.

It is a more specific object of this invention to provide an apparatus of the type employing a hopper for holding a mattress filler and for pushing the filler into a mattress cover associated with the apparatus.

It is a still further object of this invention to provide an apparatus of the type disclosed wherein the mattresses produced are automatically provided with an adhesive bond between the mattress filler and cover whereby "rolling" occasioned by relative movement between the mattress cover and filler is avoided.

It is a still further object of this invention to provide improved mattresses produced in an apparatus of the type described.

These and other objects of this invention will appear hereinafter and for purposes of illustration, but not of limitation, specific embodiments of the invention are shown in the accompanying drawings in which.

Figure 11:
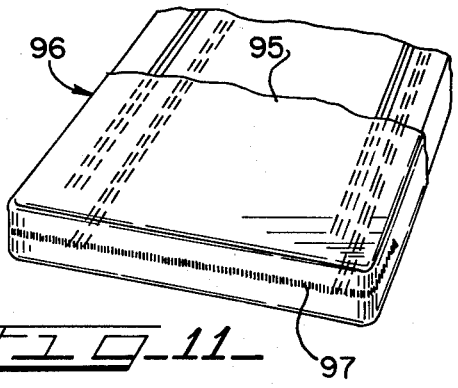
Figure 10:
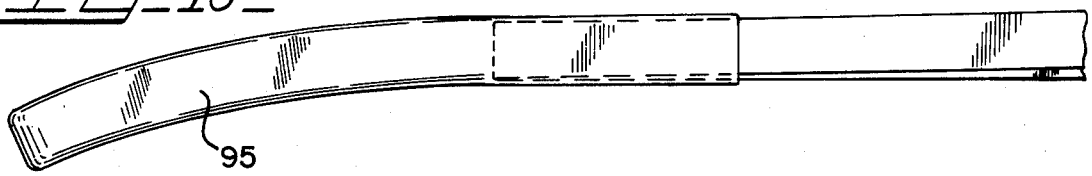

FIG. **9*a*** is a schematic illustration of a limit valve control mechanism utilized in the apparatus;

FIG. **9*b*** is a schematic plan view of the gear and rack mechanisms employed for adjusting the hopper width;

FIG. 10 is a schematic illustration of a mattress cover associated with the apparatus of the invention; and, FIG. 11 is a perspective view of a mattress of the type produced in accordance with the invention.

This invention generally relates to an apparatus for filling a flexible cover with a resilient filler for the formation of a mattress or the like. The apparatus employed is of the type including a hopper defining an interior space for receiving the filler and also defining an open end. The mattress cover is adapted to be positioned around the open end of the hopper so that the interior of the cover communicates with the open end. Filler engaging means then serve to push the filler into the cover to form the desired assembly.

One aspect of the invention is directed to the utilization of adhesive dispensing means positioned on the hopper. At least one surface of a filler is located adjacent the dispensing means when the filler is in the hopper, and the dispensing means are operated during movement of the filler into the cover. This results in the application of adhesive to the filler surface whereby contact of that surface with the opposed interior surface of the cover results in the formation of a secure bond between the filler and the cover.

The apparatus also provides an efficient arrangement for accommodating the production of mattresses of different sizes. In particular, the pusher bars employed for engaging the filler are designed to automatically accommodate differences in height whereby mattresses of greater or lessor thickness can be produced with the apparatus. Furthermore, the pusher bars are adapted for adjustment lengthwise so that the apparatus is useful for the production of mattresses of different width. The bars are connected together by means of pivotally attached plates and links to insure synchronization of movement. Springs associated with the plates automatically urge the bars into positions to accommodate different thicknesses.

Figure 1:
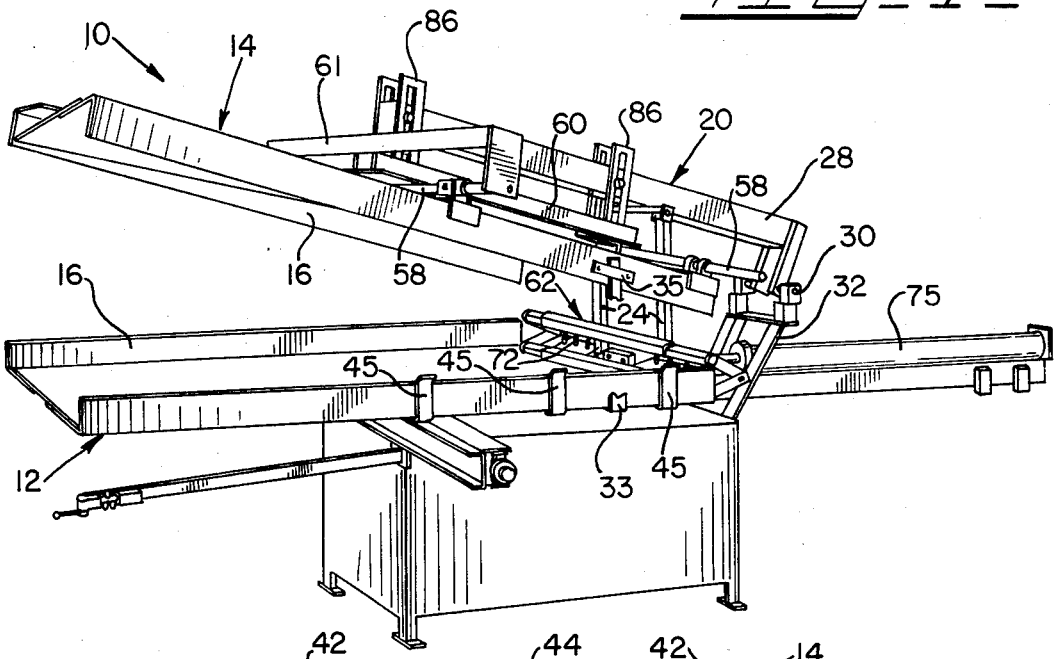
FIG. 1 is a perspective view of the apparatus utilized for the production of mattresses.
Figure 2:
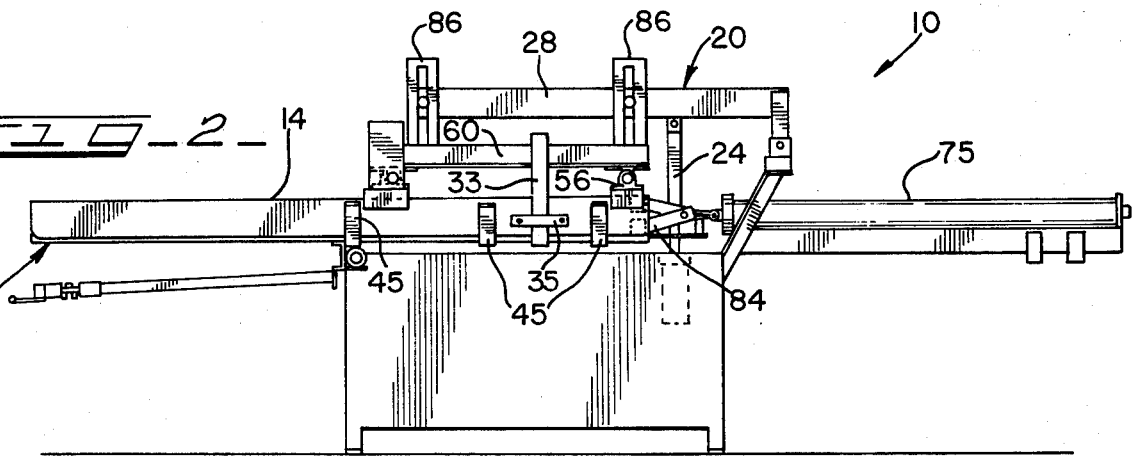
FIG. 2 is a side elevation of the apparatus in a condition ready for the attachment of a mattress cover.

The accompanying drawings illustrate a construction 10 characterized by the features of this invention. As shown in FIG. 1, the construction generally comprises a lower hopper 12 and a pivotally connected upper hopper 14. These hoppers each define side walls 16; when the hoppers are closed as illustrated in FIG. 2, they thus define an interior space dimensioned to receive a resilient mattress filler. In accordance with such manufacturing operations, the hoppers are adapted to compress the fillers when in the closed position with the fillers expanding as they are forced into the mattress cover.

Figure 9:
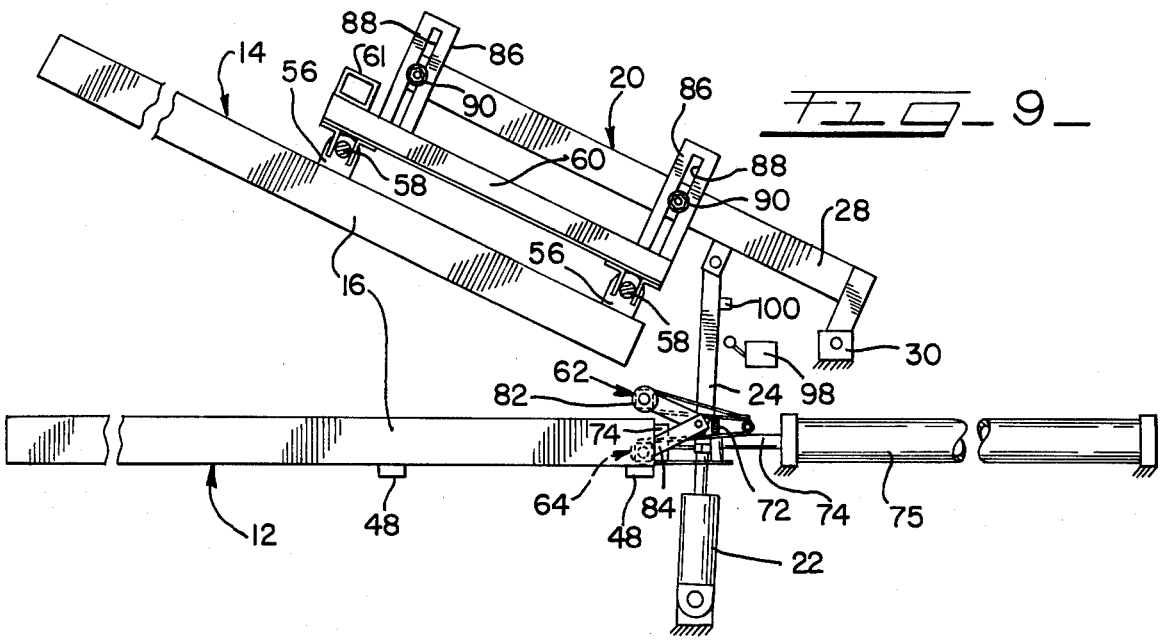
FIG. 9 is a side view of the filler engaging bars in the open position.

The lower hopper 12 is supported on an essentially stationary table while the upper hopper 14 is attached to a pivotally mounted frame 20. As shown in FIG. 9, pneumatic cylinders 22 include vertically extending pistons with extensions 24 for purposes of raising and lowering the upper hopper. The frame 20 is connected to these extension, and the transverse frame member 28 of the frame 20 is pivotally connected at 30 to a bracket 32 carried by the supporting table.

Figure 3:
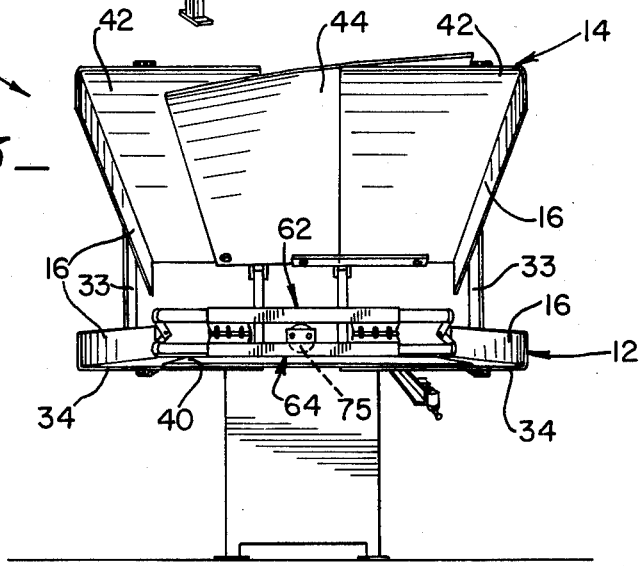
FIG. 3 is a front end view of the apparatus with the hopper in the open position.
Figure 4:
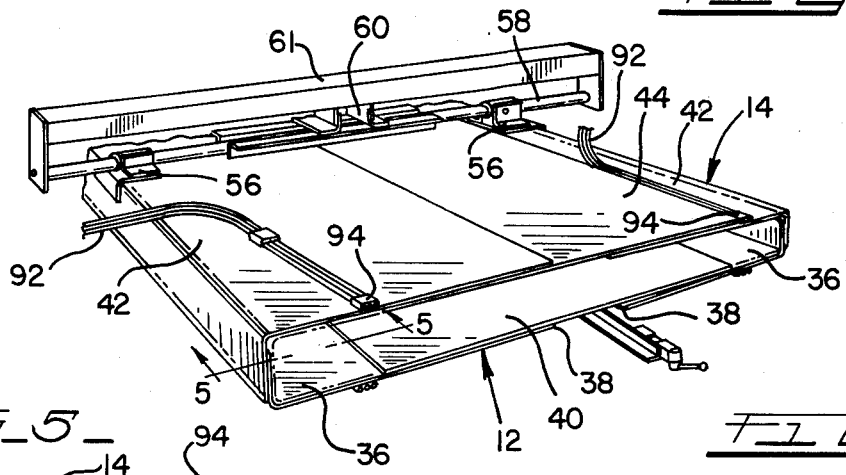
FIG. 4 is a perspective view illustrating the front end of the apparatus with the hopper in the closed position.

The apparatus provides for the accommodation of mattress fillers of different sizes and to achieve this, the hoppers 12 and 14 are formed in sections as best illustrated in FIGS. 3 and 4. The hopper 12 comprises outer sections 34 defining side walls 16 and bottom walls 36. These bottom walls extend to inner opposed edges 38, and a third section 40 extends over the bottom walls for purposes of spanning the gap between the edges 38.

The upper hopper 14 includes outer sections 42 each defining a side wall 16, and an intermediate section 44. The upper side walls 16 fit between the lower side walls 16 and clips 45 when the hopper is closed. These clips are attached to the sections 34, the clips comprising extensions of racks 48 and 50 attached to the bottom sides of the lower hopper sections 34. Guide bars 33 are also attached to the sections 34, and these bars extend through bands 35 attached to the upper hopper. This provides means for holding the upper and lower hoppers in alignment during all stages of relative movement.

The racks 48 and 50 serve as part of a drive means for adjusting the width of the hopper. As best shown in FIG. 9*b*, the racks 48 are carried by one section 34 and opposed racks 50 are carried by the other section. Pinion gears 52 are interposed between the racks.

A chain drive 57 extends between the pinion gears. The chain drive is connected to nut 71 attached to plate 59, and a screw shaft 67 is driven by an air motor (not shown) whereby rotation of the shaft will drive the plate 59. As shown, the plate is mounted on frame members 61, and is movable relative to the frame members by reason of bolts 63 received in slots 65.

The air cylinder 54 and associated piston 55 move with the plate 59, and the end of this piston is attached to a rack 48 whereby the rack also moves in response to the plate movement. This movement is transmitted through pinions 52 and chain drive 57 to the other racks whereby hopper width adjustment is readily achieved.

The arrangement described permits "squeezing" of a filler after the filler has been located in the hopper. Specifically, the distance between the extended and retracted positions of the piston 55 will be set to a selected amount, for example, one inch. With the piston extended, and after the filler is located in position and the hopper closed, the air cylinder 54 is retracted thereby imparting the desired "squeeze" to the filler. As will be more specifically described, the filler is also adapted to be pressed in a vertical direction within the hopper, and with this arrangement, the mattress cover can be readily located in place around the exterior of the hopper. Furthermore, as the filler is forced outwardly, it will expand and form a tight fitting relationship with the cover.

The driven outer sections 42 of the upper hopper carry supports 56 which receive rods 58, and these rods are tied to the upper frame member 60 by means of transverse frame member 61. These rods thus serve as guide means for the hopper sections as they are adjusted to accommodate different widths.

As indicated, structures of the type described include means for pushing the resilient filler out of the hopper. This invention involves a unique structural arrangement for such pushing means. In particular, the invention contemplates the use of upper and lower pusher bars 62 and 64. These bars comprise a central rectangular tubular section 66 and telescoping rods 68 extending outwardly from each end of the tubular section. Spring mechanisms (not shown) of conventional design are utilized for purposes of normally urging these rods outwardly.

The central sections are pivotally connected by means of upper and lower hinged plates 70. The central section 66 of the lower bar has a piston rod 74 connected thereto, and a pair of these plates is located on each side of this piston rod. Each pair has a spring 72 normally urging the plates away from each other.

The piston rod 74 is controlled by cylinder 75 whereby the assembly of bars 62 and 64 can be pushed back and forth between the upper and lower hoppers 12 and 14. The springs 72 force the bars vertically so that these bars will always be positioned substantially against the inner walls of the hoppers. Accordingly, the filler will be engaged in a manner which is most efficient from the standpoint of forcing the filler out of the hopper. The arrangement described is particularly efficient where the hoppers are set to press or squeeze the filler during movement out of the hopper.

Figure 8:
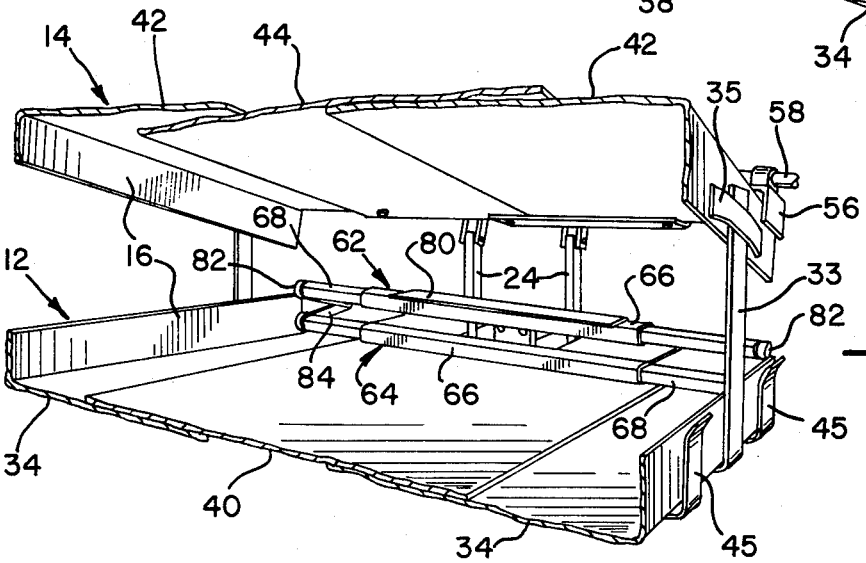
FIG. 8 is a perspective view of the filler engaging pusher bars in the closed position.

The central sections 66 may be provided with strips of high wear-resistant material such as nylon strips 80 (FIG. 8) whereby damage to the bars can be substantially avoided. Similarly, wear-resistant plastic buttons 82 may be attached at the ends of rods 68 to minimize wear problems.

The rods 68 are preferably secured together at their ends by means of links 84. These links provide improved alignment of the pusher structure.

As best illustrated in FIG. 9, the frame structure 20 utilized for supporting the upper hopper includes means for adjusting the position of this upper hopper relative to the lower hopper 12. In particular, a pair of slotted posts 86 extend upwardly from the frame member 60. Threaded pins extend outwardly from the sides of frame member 28 for receipt in the slots 88 of the posts 86. The nuts 90 are employed for securing the frame members 60 and 28 relative to each other whereby loosening of the nuts permits vertical adjustment of these frame members.

It will be appreciated that with a stationary pivot point 32, vertical adjustment of the frame member 60 relative to frame member 28 will result in changes in the position of upper hopper 14 relative to the lower hopper in response to the action of the piston rod extension 24. Such adjustments are made for purposes of controlling the amount of squeeze applied to a filler located in the machine. In addition, the adjustments permit accommodation of fillers of different sizes.

It will be noted when referring to FIGS. 2 and 10 that a degree of taper is provided between the upper and lower hoppers when in the closed position. This taper is achieved due to the setting of the nuts 90 relative to posts 86. In a typical system, the spacing between upper and lower hopper walls will vary from about 2 to about 6 inches along the 80-inch length of the hopper.

The tapered setting of the hopper has been found to significantly improve the filling operation. Thus, the filler has been found to more efficiently enter the cover with this construction and, in this connection, the structure of the pusher is particularly important. As indicated, the spring loaded bars follow the surfaces of the hoppers so that they will automatically accommodate to the taper. The bars press against the rear wall of the filler adjacent the top and bottom thereof which provides the most efficient mechanism for moving the filler into the cover.

Figure 5:
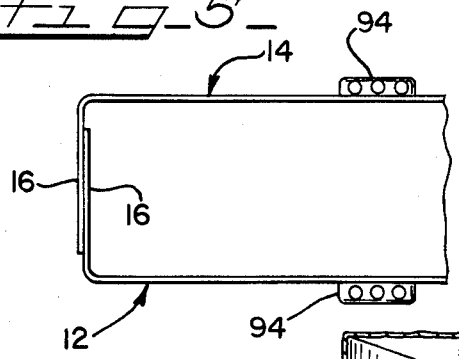
FIG. 5 is a detail fragmentary view comprising an end view of adhesive dispensing means utilized in the apparatus.
Figure 6:
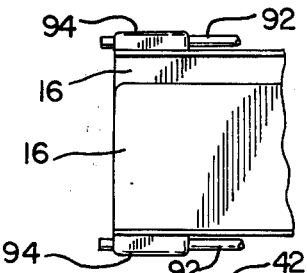
FIG. 6 is a fragmentary detail side view of the dispensing means.

As already noted, this invention also contemplates the provision of means for applying adhesive between the filler outer surfaces and the cover inner surfaces whereby the filler and cover will be securely bonded together. As illustrated in FIGS. 4, 5 and 6, these means include tubes 92 for feeding adhesive to dispensing nozzles 94. These nozzles are positioned immediately adjacent the open end of the hopper. In the embodiment illustrated, the nozzles comprise a housing attached to each outer hopper section with three nozzle ends extending outwardly of the housing for a total of 12 dispensing nozzles. As illustrated, the nozzle ends extend slightly beyond the outer edges of the hopper sections.

Figure 7:
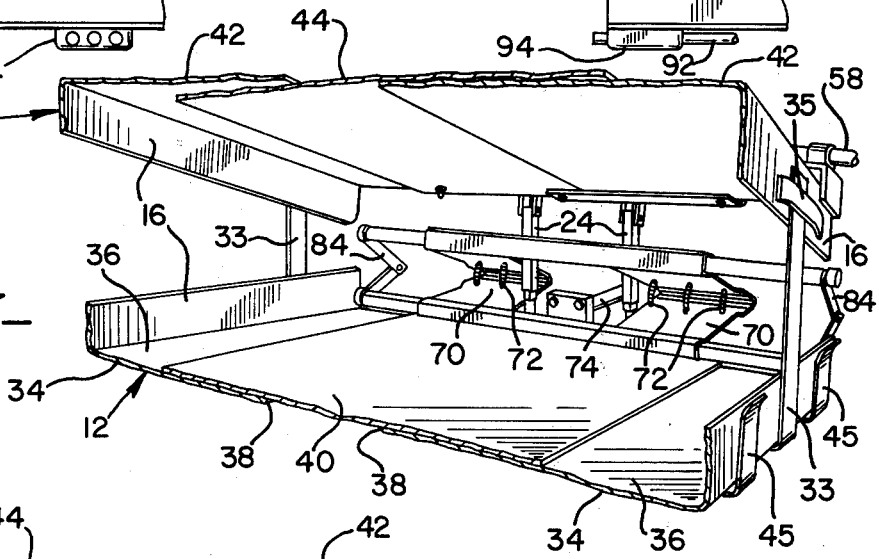
FIG. 7 is a perspective view of the filler engaging pusher bars shown in the open position.

In the operation of the apparatus, the hoppers are initially in the open position as shown in FIGS. 1 and 7. A filler is inserted in the hopper with one end adjacent the pusher bars and the other end adjacent the open end of the hopper, the distance from the open end being dependent on the size of the mattress construction being produced. The hopper is then closed to provide the arrangement shown in FIG. 2. As indicated, it is preferable that the frame members 28 and 60 be adjusted so that the filler is compressed when the hopper has been moved to the closed position.

A mattress cover is fit around the open end of the hopper as shown in FIG. 10. The interior of the mattress cover is, thus, placed in communication with the interior of the hopper. The piston 74 then drives the pusher bars against the filler to force the filler into the mattress cover.

As the filler is forced out of the hopper, the adhesive dispensing nozzles are operated to apply adhesive to the filler surfaces. In the embodiment shown, these nozzles can be operated to simultaneously apply 12 strips of adhesive substantially along the length of the filler. Particularly since the filler is compressed until exiting from the hopper, it will be appreciated that the filler is adapted to press into contact with the cover interior surfaces. A secure bond between the cover surfaces and the filler can, therefore, be automatically achieved with the construction of this invention.

FIG. 11 illustrates the mattress 96 produced with the construction of this invention. As shown in dotted lines, the adhesive strips provide a bond in several positions, it being appreciated that a greater or lesser number of bonded areas as well as interrupted lines could be utilized depending upon the type of mattress involved and the intended use of the mattress. The mattress cover may be provided with a zipper 97 to provide a convenient closure for the mattress.

As indicated, a pneumatic cylinder and piston may be utilized for raising and lowering the upper hopper and for adjusting the hopper width, and a cylinder and piston arrangement is also suitable for operating the pusher. Manual and limit valves are utilized in an operating circuit for the system so that the sequence of operations can be controlled. In a typical system, with a filler positioned in the open hopper, the machine is started and then the first limit valve to operate will be the limit valve 98 operated by pin 100 associated with hopper piston extension 24. This occurs when the upper hopper is being lowered, the limit valve initiating operation of squeeze cylinder 54. The cover 95 is then located in place and a foot valve is operated to start forward movement of piston rod 74 connected to the pusher arms.

Figure 9A:
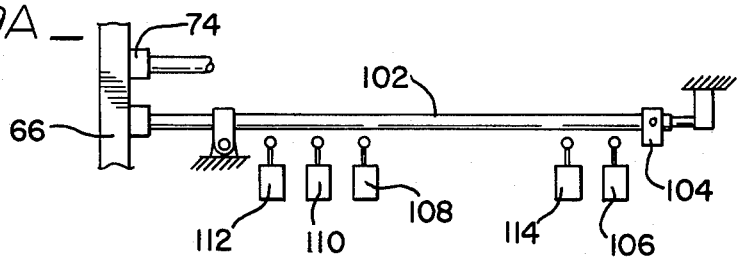
Figure 9B:
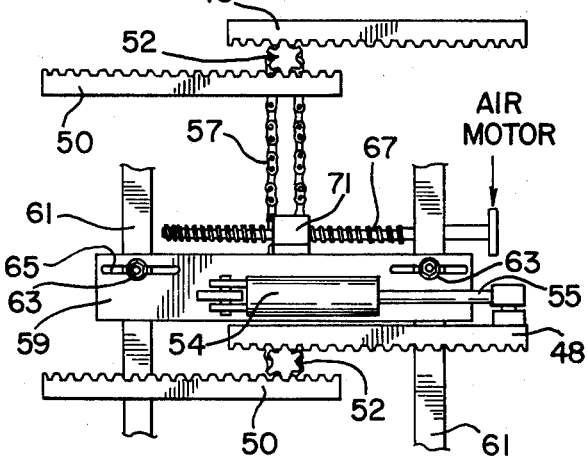

As shown in FIG. 9*a,* an additional rod 102 is connected to the pusher section 66, and this rod is moved along with the pusher section by the action of rod 74. An actuating cam 104 is carried by the rod 102 for operating additional limit valves. In particular, the initial movement of the rod 102 operates limit valve 106 which initiates the operation of a pump for feeding adhesive through lines 92 to the nozzles 94. Thus, adhesive application starts shortly after the filler movement begins.

Continued movement results in the actuation of limit valve 18 to close a valve in the line leading to the adhesive pump, this occurring near the end of the forward movement of the pusher. The next limit valve 110 operates to reverse the pumping action to thereby suck adhesive at the ends of the nozzles into the lines 92 to prevent dripping.

The final limit valve 112 is actuated at the end of the forward stroke, and this reverses the movement of piston 74 for returning the pushers to the starting position. During this return movement, limit valve 114 is engaged to initiate operation of the piston extension 24 by cylinder 22 for raising the hopper. The next cycle of operation is initiated by a manual valve after the next filler is in place. Similarly, a manual valve is utilized for initiating operation of the pusher rods after the mattress cover has been associated with the closed hopper.

It will be understood that various changes and modifications may be made in the above described construction which provide the characteristics of this invention without departing from the spirit thereof particlarly as defined in the following claims.

That which is claimed is:

1. In an apparatus for filling a flexible cover with a resilient filler for the formation of mattresses or the like, said apparatus including a hopper defining a filler receiving space and an open end, said cover being dimensioned for attachment to the hopper whereby the interior of the cover communicates with said open end of the hopper, and means for driving said filler into said cover, the improvement comprising adhesive dispensing means positioned on said hopper, at least one surface of the filler being located adjacent said dispensing means when the filler is in the hopper, and means for operating said dispensing means during movement of the filler into the cover whereby adhesive is deposited on the filler surface for contact with an opposed cover surface whereby the cover is adhered to the filler.

2. An apparatus in accordance with claim 1 wherein said hopper comprises upper and lower sections, said dispensing means being associated with each of said sections for depositing adhesive on the opposite sides of the filler for contact with cover surfaces adjacent each of said opposite sides.

3. An apparatus in accordance with claim 1 wherein said dispensing means comprise outlet nozzles secured to said hopper adjacent said open end.

4. An apparatus in accordance with claim 3 including a plurality of said outlet nozzles, said nozzles depositing parallel lines of adhesive onto said filler surface.

5. An apparatus in accordance with claim 4 including a plurality of adhesive supply lines carried on said hopper and communicating with said nozzles, and a common source of adhesive for delivering adhesive to said supply lines.

6. An apparatus in accordance with claim 5 wherein said hopper comprises upper and lower sections, said supply lines comprising flexible hoses mounted on said sections, said sections being movable between open and closed positions with said supply lines moving with said sections.

7. An apparatus in accordance with claim 2 including means for adjusting the size of the filler receiving space by moving said sections relative to each other, said means for adjusting the size of the filler receiving space including means operating after receipt of the filler within the space adapted to compress the filler within the hopper.

8. In an apparatus for filling a flexible cover with a resilient filler for the formation of mattresses or the like, said apparatus including a hopper defining a filler receiving space and an open end, said cover being dimensioned for attachment to the hopper whereby the interior of the cover communicates with said open end of the hopper, and means for driving said filler into said cover, the improvement wherein said means for driving said filler comprises a pair of spaced apart filler engaging members adapted to assume a first position in the hopper spaced from said open end, drive means connected to said engaging members for moving the members toward said opened end, and resilient means interposed between said members for forcing the members apart and toward the hopper walls.

9. An apparatus in accordance with claim 8 wherein said hopper consists of upper and lower sections, and means for adjusting the size of the filler receiving space by moving said sections relative to each other, said resilient means operating to cause said engaging members to automatically adjust to changes in the spacing between said sections.

10. An apparatus in accordance with claim 9 including means for laterally adjusting the filler receiving space defined by said sections to accommodate fillers of different width, and means for changing the length of said filler engaging members to accommodate changes in lateral adjustment of said sections.

11. An apparatus in accordance with claim 8 wherein said filler engaging members comprise transversely extending bars.

12. An apparatus in accordance with claim 11 including plates extending outwardly from said bars, means pivotally connecting said plates, and wherein said resilient means extend between said plates whereby pivoting movement of the plates results in movement of said bars toward the hopper walls, and including pivotally connected link means at the ends of said bars.

13. An apparatus in accordance with claim 12 wherein said resilient means comprise compression springs.

14. An apparatus in accordance with claim 11 wherein said bars are formed of telescoping sections whereby the length of the bars can be changed to accommodate fillers of different width.

15. An apparatus in accordance with claim 12 including wear resistant means positioned on the bar surfaces in engagement with the hopper walls.

16. An apparatus in accordance with claim 8 wherein said drive means comprise a cylinder, and a piston rod associated with said cylinder attached to one of said filler engaging members.

17. An apparatus in accordance with claim 16 wherein said filler engaging members comprise transversely extending bars, pivotally attached plates supporting said bars, and said resilient means being positioned between said plates, the driving movement imparted to one of said members by said piston rod being transmitted through the other of said members by said plates.

18. An apparatus in accordance with claim 17 including pivotally connected link means at the ends of said bars.

19. An apparatus in accordance with claim 9 wherein said means for adjusting the size of the filler receiving space include means operating after receipt of the filler within the space adapted to compress the filler within the hopper.

20. An apparatus in accordance with claim 9 wherein said means for adjusting the size of the filler receiving space include means for tapering the upper and lower hopper sections relative to each other whereby the height of said space gradually increases from said open end to the other end of the hopper.

21. An apparatus in accordance with claim 20 wherein said taper varies from about 2 to about 6 inches along the length of said hopper.

* * * * *